United States Patent [19]

Stefan

[11] Patent Number: 4,577,446

[45] Date of Patent: Mar. 25, 1986

[54] MACHINE WALL

[76] Inventor: Alexander Stefan, 3120 S. Highland Dr., Las Vegas, Nev. 89109

[21] Appl. No.: 587,462

[22] Filed: Mar. 8, 1984

[51] Int. Cl.[4] ..... E04F 15/14

[52] U.S. Cl. ..... 52/425; 52/421

[58] Field of Search ..... 52/318, 437, 415, 421, 52/600, 425

[56] References Cited

U.S. PATENT DOCUMENTS 1,974,279 9/1934 Jones ..... 52/318 X 2,238,355 4/1941 Whitenack ..... 52/318 X

FOREIGN PATENT DOCUMENTS 766277 1/1957 United Kingdom ..... 52/318

*Primary Examiner*—Carl D. Friedman

*Assistant Examiner*—Naoko N. Slack

[57] ABSTRACT

This invention is a wall construction, made from a honey-combed framework and a concrete poured into the framework; the framework being made from expanded metal strips.

1 Claim, 8 Drawing Figures

17
17

28
22
22
23
28
23
23
23
13,15

24
22
28

22
22
28
23
28
14
23

22
25
28

18
18
21
22
22
20
19
18
21
20
18
16

12
10
6
22
22
25
11
24
23
25
27
27
15
12
14
13
6

5
22
23
12
26
22
18
5

MACHINE WALL

This invention relates generally to wall constructions. More specifically, it relates to reinforced concrete walls, such as are constructed for buildings and the like.

The use of embedded metal framework for constructing a reinforced concrete building wall is well known. Such framework is generally strong, in order to add rigidity to the structure, so is made from substantial materials, and thus is necessarily expensive, as well as being heavy to handle on the job, whereby construction is slow.

A principal object of the present invention is to provide a wall construction having advantages over the above-described, embedded structure, by being made from a light-weight, expanded metal screening, so as to form a honey-combed framework, within which any appropriate building material, such as concrete, or the like is placed to make a wall.

Another object is to provide a wall, wherein the honey-combed form is quickly and easily made, at a building site, from only either a bundle of basic strips or else a roll or flat strips of expanded metal, delivered at the site together with a forming machine.

Another object is to provide a machine wall, that is suitable for building structure or for any other purpose.

Other objects are to provide a machine wall, which is simple in design, inexpensive to manufacture, rugged in construction, easy to use, and efficient in operation.

These, and other objects, will be readily evident, upon a study of the following specification, and the accompanying drawing, wherein.

Figures 1, 2, 3, 3A, 4, 4A, 5, 6:
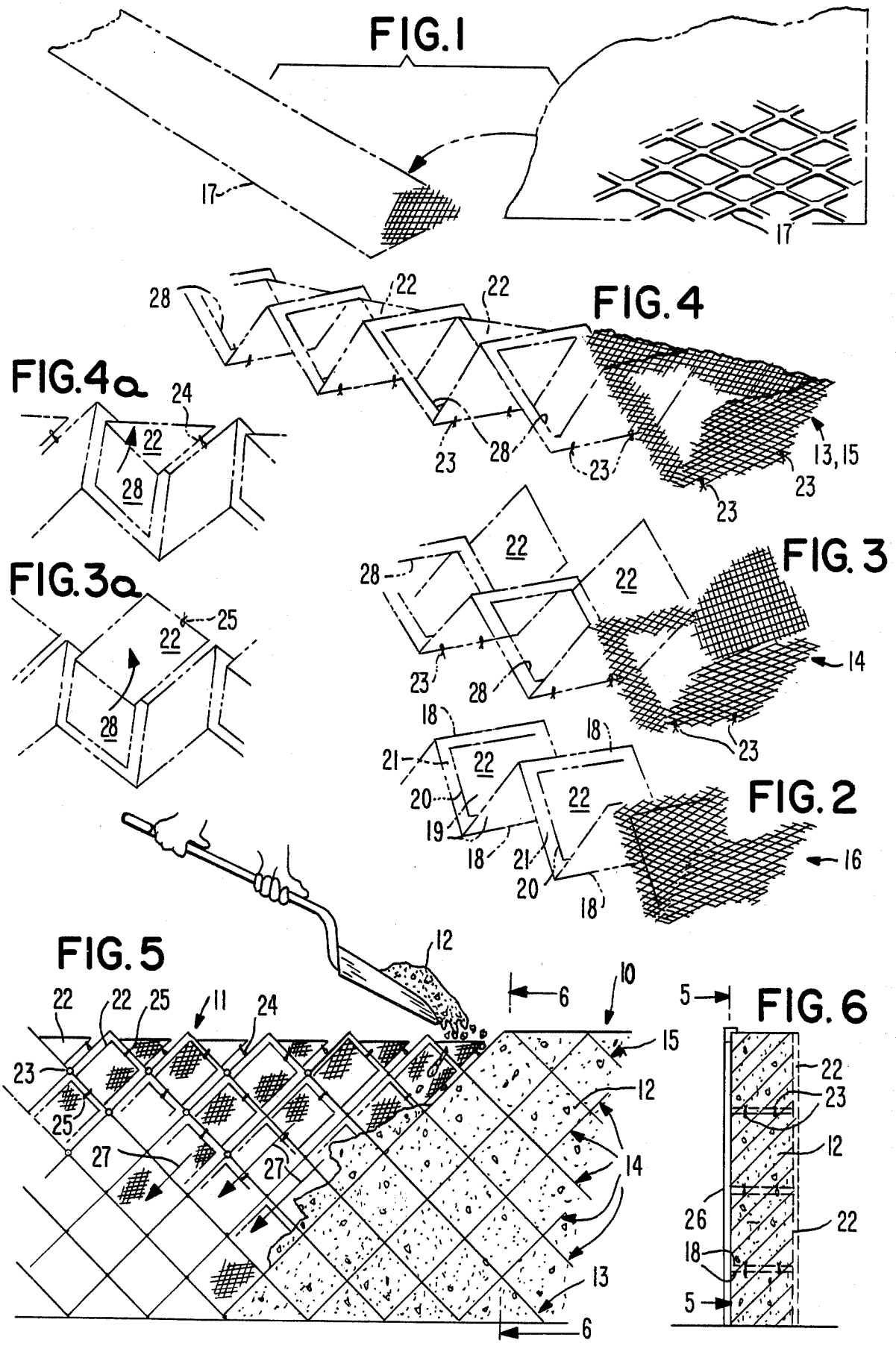
FIG. 1 is a fragmentary plan view of a strip of expanded metal, from which the wall framework is formed.
FIG. 2 is a fragmentary perspective view of an expanded metal strip, after being die cut and bent, so as to form a basic strip from which the courses of a wall are then made.
FIG. 3 is a fragmentary perspective view of a course that is made from the basic strip, and which serves to form the central courses of a wall, between a bottom and top course thereof.

FIG. 3*a* is a diagrammatic, downward perspective view, similar to FIG. 3, but viewed slightly more from the left, in order to show fully the bent-up tabs thereof;

FIG. 4 is a fragmentary perspective view of a course that is made from the basic strip, and which serves to form the bottom and top courses of a wall;

FIG. 4*a* is a diagrammatic, downward perspective view, similar to FIG. 4 but viewed slightly more from the left, in order to show fully the bent-up tabs thereof;

FIG. 5 is a view on line 5—5 of FIG. 6, and showing a wall in the process of being constructed, and FIG. 6 is a cross-sectional view, taken on line 6—6 of FIG. 5.

Referring now to the drawing in greater detail, the reference numeral 10 represents a machine wall, according to the present invention wherein there is a framework 11, and a quantity of concrete 12 that is poured into the framework.

The framework comprises a plurality of horizontal courses, that are laid one upon another, up to the full height of the wall. The courses include a single bottom course 13, upon which are laid a plurality of middle or central courses 14, and upon this, a single top course 15 is placed.

All these courses are made from a basic strip 16, shown in FIG. 2. This basic strip is made from a flat long strip of expanded metal 17, shown in FIG. 1, and which is then bent into a zig-zag configuration by means of transverse, right angle, adjacent upwardly and downwardly bends 18, so as to make a plurality of same-sized flat panels 19 therebetween. Each alternate panel is additionally die cut, with a generally "U"-shaped slit 20, spaced from three side edges of the panel, leaving a narrow edge area 21, and producing a central tongue or flap 22, that are subsequently bent upwardly at right angles. When producing the middle course 14, the flap is left a full rectangular size. When producing the bottom or top course 13 or 15, the upwardly projecting half of the flap is cut off, leaving the flap triangular-shaped. The top and bottom courses are manufactured exactly the same, and their only difference is that, in the installation, the bottom course may be, first, turned upside down and also horizontally rotated, prior to being laid down.

When erecting the framework at a building site, the courses are placed one upon another, with the bends 18 of one course abutting the bends 18 of an adjacent course. The courses are then attached together by wire clips 23, through the abutting bend edges. At the same time, the triangular flaps are secured by wire clips 24 to the same course, and the rectangular flaps are secured by wire clips 25 to an adjacent course, so that the flaps thus together form a rigid side wall on one side of the framework. As shown in FIG. 6, a temporary side wall 26, made either of plywood, or other rigid material, is placed adjacent the other side, for holding the framework erect during a subsequent concrete pouring operation. As indicated by arrows 27, in FIG. 5, the courses are laid so that the openings 28, formed by the flaps, align on all the courses, so that, when concrete 12 is poured on top of the framework, it runs down through all the openings to the framework bottom, as shown.

It is now apparent that this design of framework permits transporting to the building site only a conveniently handled, compact bundle of basic strips 16, that have been made in a factory. Alternately, this may comprise a bundle of the flat strips 17, that are brought to the site together with a portable machine, which finishes them there into the courses 13 and 15.

While various changes may be made in the detail construction, it is understood that such changes will be within the spirit and scope of the present invention, as is defined by the appended claims.

What I claim as new is:

1. A machine wall, comprising, in combination, a framework and a quantity of concrete for being poured into said framework, said framework comprising a plurality of horizontal courses laid one upon another and fastened together, each said course comprising a strip of bent up, expanded metal screening bent into a zig-zag configuration by right angle, alternate upwardly and downwardly bends and forming a plurality of same-sized flat panels between said bends, said courses being wired together at adjacent said bends to form said framework, all said panels of said courses extending angularly upwardly and forming a honey-combed structure for said framework, and some of said panels including a flap die cut in a center thereof, said flap being outwardly bent up at right angle, said bent up flaps together forming a vertical, general wall on one side of said framework, and means for said concrete being poured inside said honey-combed structure.

* * * * *